US005404590A

United States Patent [19]

Monica, Jr.

[11] Patent Number: 5,404,590

[45] Date of Patent: Apr. 11, 1995

[54] FOOTBALL HELMET MOTION RESTRICTOR

[75] Inventor: Theodore A. Monica, Jr., Stroudsburg, Pa.

[73] Assignee: Riddell, Inc., Chicago, Ill.

[21] Appl. No.: 130,653

[22] Filed: Oct. 1, 1993

[51] Int. Cl.[6] ..... A41D 13/00

[52] U.S. Cl. ..... 2/2; 2/425

[58] Field of Search ..... 2/2, 410, 411, 415, 2/421, 425, 44, 45, 424, 422; 602/17, 18, 19

[56] References Cited

U.S. PATENT DOCUMENTS 3,366,970 2/1968 Morgan ..... 2/2
3,514,784 6/1970 McDavid ..... 2/2
4,338,685 7/1982 LaPorta ..... 2/2
4,821,339 4/1989 Fair ..... 2/2
4,996,720 3/1991 Fair ..... 2/2
5,287,562 2/1994 Rush, III ..... 2/415

FOREIGN PATENT DOCUMENTS 2452299 11/1980 France ..... 2/2

*Primary Examiner*—Peter Nerbun
*Assistant Examiner*—Larry O. Worrell, Jr.
*Attorney, Agent, or Firm*—Ben D. Tobor

[57] ABSTRACT

A football helmet motion restrictor is provided which can be adjusted to vary its size, and does not reduce the size of the neck opening of the shoulder pads to which the motion restrictor is mounted.

18 Claims, 2 Drawing Sheets

Fig. 1
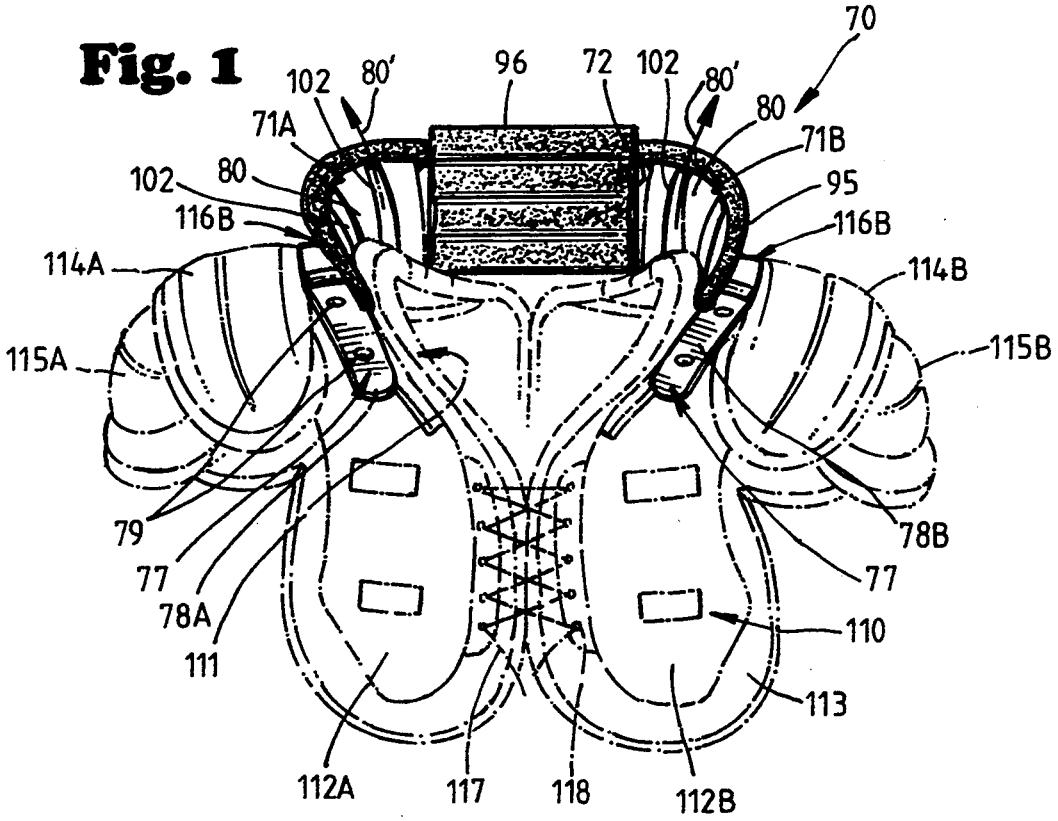
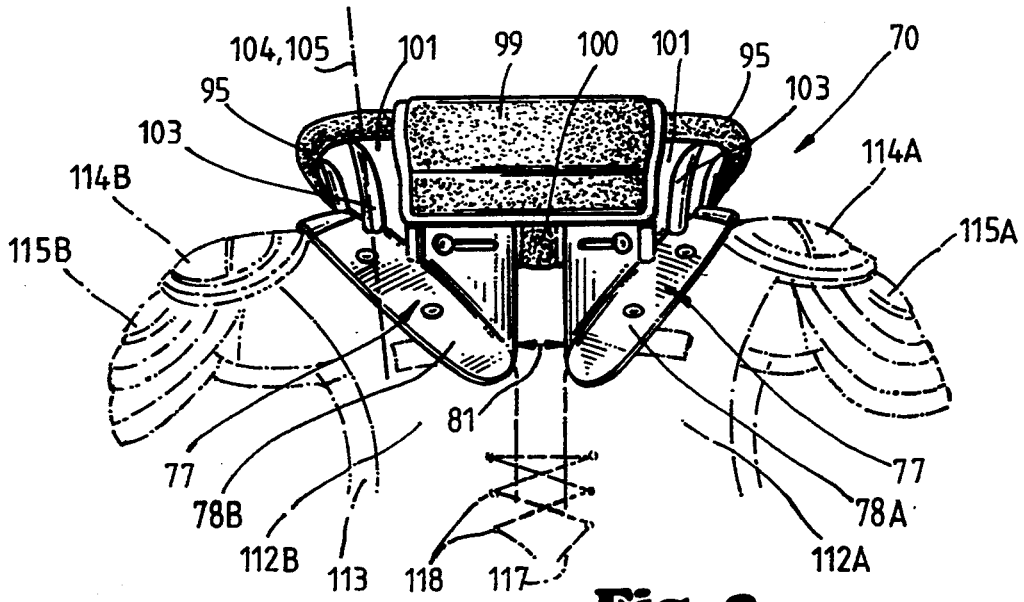
Fig. 2

Fig. 3
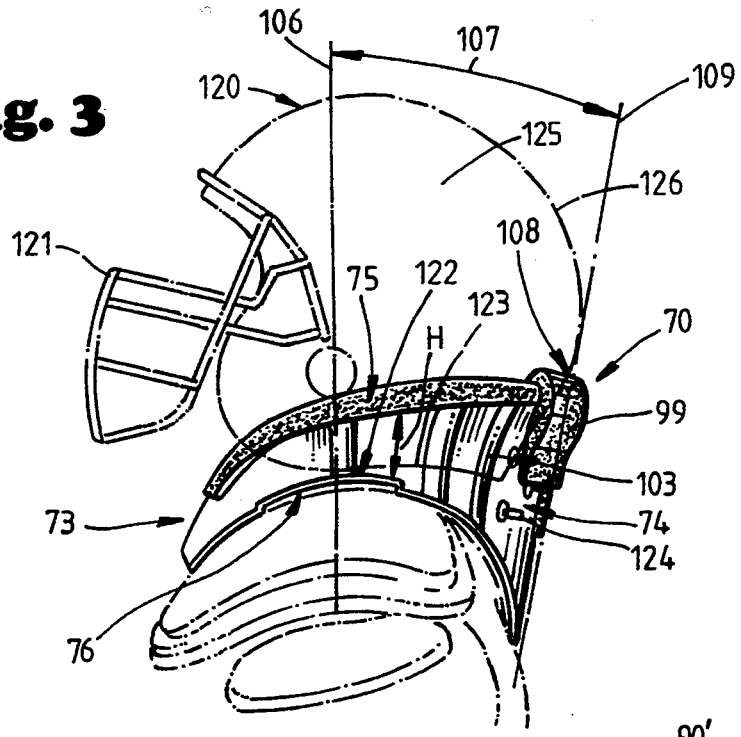
Fig. 4
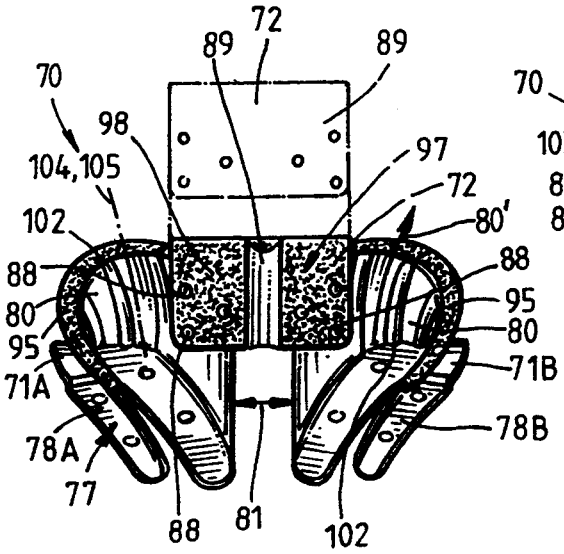
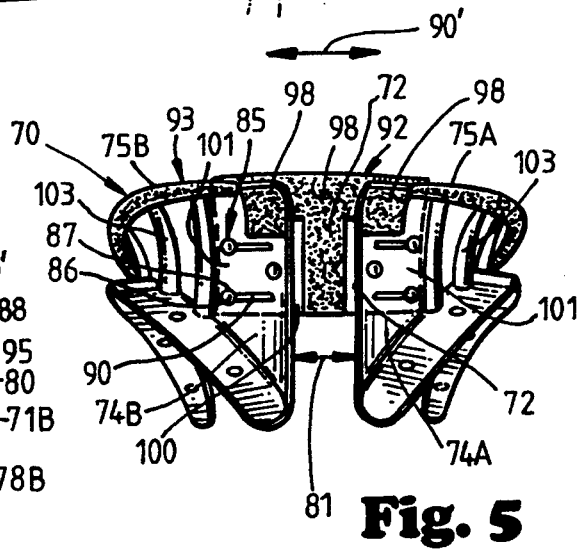
Fig. 5
Fig. 6
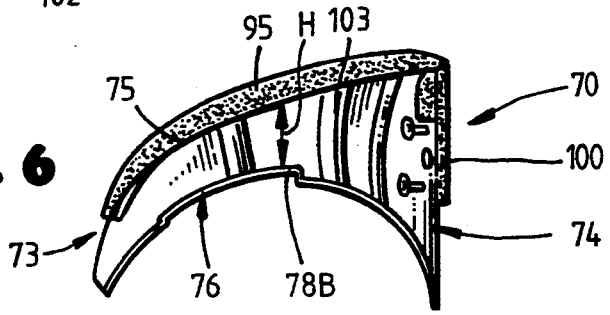

FOOTBALL HELMET MOTION RESTRICTOR

BACKGROUND OF THE INVENTION

1. Field of the Invention

The present invention relates to a football helmet motion restrictor for use by a person wearing a football helmet and football shoulder pads to restrict undesired lateral and posterior movement of the football helmet.

2. Description of the Prior Art

In the sport of football, football players wear protective gear generally comprised of structural members lined with padding, such as shoulder pads, and protective headgear, such as conventional football helmets. Various devices have been proposed to eliminate, or restrict, undesired lateral and posterior movement of the football helmet, with a view toward preventing injury to the football player's neck, upon the football player receiving either a blow to the head, or a blow to his body which causes his neck to move laterally, or from side-to-side, or in a posterior direction, or toward the back of the football player.

Cervical collars, and similar devices, have been previously proposed to restrict undesired lateral posterior movement of a player's football helmet, and in turn restrict undesired lateral and posterior movement of the football player's neck. It is an object of the present invention to provide better protection than that previously afforded by prior art cervical collars and similar device, against undesired lateral and posterior movement of a football player's helmet and neck.

It should be noted that as to the football helmet motion restrictor of the present invention, as well as prior art protective devices, due to the nature of the sport of football, no protective equipment can completely prevent injuries to those playing the sport of football; however, it is believed that such equipment can be designed to attempt to better protect the player from injuries. It should be further noted that no protective equipment can completely prevent injuries to a player, if the football player uses his football helmet to butt, ram, or spear an opposing player, which is in violation of the rules of football. Improper use of a helmet to butt, ram, or spear an opposing player can result in severe head or neck injuries, paralysis, or death to the football player, as well as possible injury to the football player's opponent. No football helmet, nor football helmet motion restrictor, such as that of the present invention, can prevent all head or neck injuries a football player might receive while participating in the sport of football, particularly if the football player improperly uses his helmet.

SUMMARY OF THE INVENTION

In accordance with the present invention, a football helmet motion restrictor is provided for use by a person wearing a football helmet and football shoulder pads, having a neck opening, to restrict undesired lateral and posterior movement of the football helmet. The football helmet motion restrictor of the present invention includes: a pair of bilaterally symmetrical side members made of a rigid plastic material, each side member having a front and rear portion and an upper and lower end, and a mounting surface on the lower end adapted to be fixedly secured to the shoulder pads, each side member having an upwardly extending inner wall surface which flares upwardly and outwardly from the lower end to the upper end; the lower end of each side member being sized to generally conform to the size and shape of the neck opening of the shoulder pads; the upper end of each side member being sized to be larger than the size and shape of the neck opening of the shoulder pads; the inner wall surface of each side member having a height which tapers downwardly from the rear portion to the front portion; and a substantially flat connector plate member made of a rigid plastic material disposed between, and connecting, the rear portions of the side members, whereby posterior motion of the football helmet is restricted when the football helmet contacts the connector plate member, and lateral motion of the football helmet is restricted when the football helmet contacts the inner wall surface of the side members.

Another feature of the present invention is that the connector plate member may include a means for adjustably securing the connector plate member to the rear portions of the side members to permit the distance between the rear portions of the side members to be increased or decreased to conform with the size of the neck opening. Another feature of the present invention is that a layer of padding material may be disposed on the upper end of each side member.

The football helmet motion restrictor of the present invention is believed to have the advantage of being designed to attempt to better protect the football player by attempting to restrict undesired lateral and posterior movement of the football helmet upon the football player's head or body receiving a blow which causes his neck and/or helmet to move in a lateral or posterior direction.

BRIEF DESCRIPTION OF THE DRAWING

In the Drawing:

FIG. 1 is a front view of a football shoulder pad for a football player having the football helmet motion restrictor of the present invention mounted on the shoulder pads;

FIG. 2 is a rear view of the shoulder pads and football helmet motion restrictor of FIG. 1;

FIG. 3 is a side view of the football helmet motion restrictor, a portion of the shoulder pads, and a football helmet being used therewith;

FIG. 4 is a front view of the football helmet motion restrictor in accordance with the present invention;

FIG. 5 is a rear view of the football helmet motion restrictor of FIG. 4; and FIG. 6 is a side view of the football helmet motion restrictor of FIG. 4.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

With reference to FIGS. 1–6, the football helmet motion restrictor, or motion restrictor, 70 of the present invention for use by a person (not shown) wearing a football helmet 120 (FIG. 3) and football shoulder pads 110 (FIGS. 1 and 2), the football shoulder pads 110 having a neck opening 111, to restrict undesired lateral and posterior movement of the football helmet 120, generally includes a pair of bilaterally symmetrical side members 71A, 71B made of a rigid plastic material; and a substantially flat connector plate member 72, best seen in FIG. 5, made of a rigid plastic material disposed between, and connecting, side members 71A, 71B. The side members 71A, 71B, and connector plate member 72 may be made of any suitable rigid plastic material typically used for football protective equipment, such as a 0.140 gauge high density/high molecular weight polyethylene plastic, or any other similar material having the requisite strength characteristics to be used in football protective equipment and function in the manner to be hereinafter described. Throughout this specification and the Drawing, reference numerals including the letter "A" will be used for bilaterally symmetrical components disposed on the left and the letter "B" will be used for those disposed on the right.

As seen in FIGS. 1 and 2, football shoulder pads 110 may be of conventional construction, and typically include a pair of bilaterally symmetrical body arch members 112A, 112B which in turn are connected to a conventional pad body 113. Shoulder pads 110 also include pairs of conventional epaulets 114A, 114B and shoulder cups 115A, 115B. As will be hereinafter described, motion restrictor 70 is secured to upper portions 116A, 116B of body arch members 112A, 112B and motion restrictor 70 is disposed generally adjacent neck opening 111 of shoulder pads 110, as seen in FIG. 1. The upper portions 116A, 116B of arch members 112A, 112B generally define neck opening 111. In a conventional manner, the size of shoulder pads 110, including the size of neck opening 111, may be adjusted by adjusting the space between body arch members 112A, 112B at the front and rear of shoulder pads 110, as by the use of conventional lacings 117 which cooperate with lace openings 118 at the front and rear of shoulder pads 110.

As seen in FIG. 3, football helmet 120 may be of conventional construction and manufactured of a suitable rigid plastic material and may include a conventional face mask 121. Helmet 120 has a lower rim 122, which includes a lateral lower rim portion 123, and a posterior lower rim portion 124. Helmet 120 also includes a side wall surface 125 and a posterior wall surface 126.

Side members 71A, 71B each have a front and rear portion 73, 74 and an upper and a lower end 75, 76. Each side member 71 is provided with a mounting surface 77A, 77B disposed on the lower end 76; the mounting surface 77 being adapted to be fixedly secured to the shoulder pads 110. Preferably, mounting surface 77 is an outwardly extending flange member 78A, 78B formed integral with the lower end 76 of each side member 71. Each flange member 78 has a generally curved configuration, as seen in FIGS. 3 and 6, which conforms to the shape of the upper portions 116 of each body arch member 112 of shoulder pads 110. Likewise, the lower end 76 of each side member 71 is sized to generally conform to the configuration of the upper portions 116 of body arch members 112 of shoulder pads 110, as well as being sized to generally conform to the size and shape of neck opening 111, as seen in FIG. 1. Mounting surface 77, or flange member 78 of each side member 71 may be fixedly secured to body arch members 112, as by a plurality of rivets 79, or other suitable fastening means, which secure each side member to the upper portions 116 of body arch members 112 of shoulder pads 110.

Each side member 71 has an upwardly extending inner wall surface 80 which flares upwardly and outwardly from the lower end 76 to the upper end 75 of each side member 71, as best seen, and as illustrated by arrows 80', in FIGS. 1 and 4. Each inner wall surface 80 has a height H (FIG. 6) which tapers downwardly from the rear portion 74 to the front portion 73 of each side member 71. As seen in FIG. 2, there is a gap, or distance, shown by arrows 81 in FIG. 2 between the side members 71A, 71B; the size of the gap 81 being dependent upon how closely body arch members 112 are disposed by the use of lacings 117.

Connector plate member 72 is disposed between, and connecting, the rear portions 74A, 74B of the side members 71A, 71B, as best seen in FIGS. 2, 4, and 5. Preferably, connector plate member 72 includes a means for adjustably securing 85 (FIG. 5) the connector plate member 72 to the rear portions 74 of the side members 71 to permit the gap, or distance, 82 between the rear portions 74 of the side members 71 to be increased or decreased to conform with the size of the neck opening 111 of should pads 110. Adjustable securing means 85 may include a plurality of screws and washers 86, 87 which pass through the rear portions 74 of side member 71 and are threadedly received within threaded anchor members 88 (FIG. 4) fixedly secured to an inner wall surface 89 of connector plate member 72, as seen in FIG. 4. The rear portions 74 of side members 71 are provided with a plurality of slots 90 which receive screws 86, whereby relative motion, in the direction of arrows 90' (FIG. 5), between the connector plate member 72 and the rear portions 74 of side members 71 may be permitted to vary the size of the gap 81 between the rear portions 74 of side members 71. By tightening screws 86 against washers 87, and locking screws 86 tightly within anchor members 88, the desired distance, or gap, 81 between the rear portions 74 of side members 71 can be obtained. It should be noted that the connector plate member 72 is disposed between, and connecting, the side members 71 with an upper end 92 of connector plate member 72 being coaxily disposed with the upper end 75 of the rear portions 74 of side members 71, whereby a generally flat continuous upper surface 93 (FIGS. 4 and 5) is provided and formed by the upper ends 75 of the rear portions 74 of side members 71 and the upper end 92 of connector plate member 72.

If desired for player comfort, a layer of padding material 95 may be disposed on the upper ends 75 of each side member 71. A layer of padding 96 may also be disposed upon the inner wall surface 89 of connector plate member 72. If the layer of padding 96 is provided on connector plate member 72, padding layer 96 and connector plate member 72 may be provided with a means for releasably securing 97 the layer of padding material 96 to the connector plate member 72. The layer of padding 96 may be provided as a separate foam pad encased in a suitable material, such as nylon, and pad 96 and the inner wall surface 89 of connector plate member 72 are provided with strips of a conventional mating hook and eye fastening material 98, such as VELCRO®. Pad 96 may thereby be releasably secured to connector plate member 72. Additionally, pad 96 may have a rearwardly extending portion 99 (FIGS. 2 and 3) which is folded over the upper end 92 of connector plate member 72, and is releasably secured to the outer wall surface 100 of connector plate member 72 and outer wall surface 101 of side members 71, by additional strips of the mating hook and eye fastening material 98.

As seen in FIGS. 1 and 4, the inner wall surfaces 80 of the side members 71 may be provided with a plurality of grooves 102, the grooves 102 extending upwardly from the lower end 76 to the upper end 75 of each side member 71. Grooves 102 provide some flexibility to the side walls 71, whereby they can be properly aligned to conform to the shape of the neck opening 111 of shoulder pads 110. A plurality of ridges 103 (FIGS. 2 and 5) may be provided on the outer wall surfaces 101 of side member 71, the ridges 103 extending upwardly from the lower end 76 to the upper end 75 of each side member 71. Ridges 103 provide additional rigidty to side members 71 to resist movement of the upper ends 75 of said members 71 in a direction inwardly toward neck opening 111, or outwardly away from neck opening 111 of shoulder pads 110. Preferably, the longitudinal axis 104, 105 of grooves 102 and ridges 103 are coincident with each other, as seen in FIGS. 2 and 4.

In using the motion restrictor 70, an athletic trainer, along with the player who will be wearing the shoulder pads 110 provided with motion restrictor 70, will determine what amount of posterior movement of helmet 120 is desired to be obtained, which will then determine where motion restrictor 70 will be fixedly secured to shoulder pads 110. For example, as seen in FIG. 3, longitudinal axis 106 generally corresponds to longitudinal axis of a person wearing helmet 120 and shoulder pads 110, when the person is standing straight. The angle shown by arrows 107 represents the amount of posterior movement that helmet 120 may move rearwardly, or in a posterior direction, before the rear surface 126 of helmet 120 contacts connector plate member 72 at the point of contact denoted by arrow 108, to thus restrain, or restrict, further undesired posterior movement of helmet 120. Axis 109 (FIGS. 3 and 6), represents the longitudinal axis of the substantially flat connector plate member 72. Dependent upon the decision reached by the athletic trainer and the football player, motion restrictor 70 would be fixedly secured to shoulder pads 110, whereby the angle 107 would typically fall within a range of from approximately 30 to approximately 60 degrees. Preferably, if motion restrictor 70 is properly mounted to shoulder pads 110, the point of contact 108 between rear surface 126 of helmet 120 and the connector plate member 72 will be located approximately 4½ to 6 inches above the lower rear, or posterior, rim 124 of helmet 120, although many factors could affect the exact distance between the posterior rim 124 of helmet 120 and the point of contact 108. Such factors include, among others: the location upon shoulder pads 110 where motion restrictor 70 is mounted; the size of the football player and the size of his helmet 120; the orientation of the football player's shoulder pads on his body with respect to his helmet 120 at the time he sustains a blow; and whether or not the player is crouching, standing upright, or laying on the ground. When mounting motion restrictor 70, an important factor in determining angle 107 for a particular player is to attempt to insure that the point of contact 108 is spaced above the posterior rim 124 of helmet 120, so that connector plate member 72 does not contact the posterior rim 124 of helmet 124. Another important factor is that the upper end 92 of connector plate member 72 should not contact, or engage the posterior rim 124 of helmet 120.

It is believed that when motion restrictor 70 is properly and carefully mounted upon shoulder pads 110, posterior motion of football helmet 120 will be restricted in the previously described manner when the football helmet 120 contacts connector plate member 72, and lateral motion of football helmet 120 will be restricted when the football helmet 120 contacts the inner wall surface 80 of the side members 71. It is believed that motion restrictor 70, of the present invention, will: not directly contact the football player's neck; not reduce the size of the neck opening 111 or the space disposed above, and defined by, neck opening 111; and permit a high degree of freedom of movement of the football player's head and helmet 120, until helmet 120 contacts motion restrictor 70, so as to promote the normally desired range of movement of the football player's head and helmet 120, which in turn provides the player with a sufficient amount of head movement to provide a sufficient amount of vision of the playing field. In this regard, it is believed that motion restrictor 70, of the present invention, does not unduly restrict the football player's line of vision, which has been the case with some prior art protective devices. It is also believed that mounting surface 77 provides for increased stability of the motion restrictor 70 with respect to shoulder pads 110.

It is to be understood that the invention is not limited to the exact details of the construction, operation, exact materials or embodiment shown and described, as abvious modifications and equivalents will be apparent to one skilled in the art. For example, the connector plate member could be designed to telescope into the rear portions of the side members. Accordingly, the invention is therefore to be limited only by the scope of the appended claims.

I claim:

1. A football helmet motion restrictor for use by a person wearing a football helmet and football shoulder pads, having a neck opening, to restrict undesired lateral and posterior movement of the football helmet, comprising:

a pair of bilaterally symmetrical side members made of a rigid plastic material, each side member having a front and rear portion and an upper and lower end, and a mounting surface on the lower end adapted to be fixedly secured to the shoulder pads, each side member having an upwardly extending inner wall surface which flares upwardly and outwardly from the lower end to the upper end; the lower end of each side member being sized to generally conform to the size and shape of the neck opening of the shoulder pads; the upper end of each side member being sized to be larger than the size and shape of the neck opening of the shoulder pads; and the inner wall surface of each side member having a height which tapers downwardly from the rear portion to the front portion; and a substantially flat connector plate member made of a rigid plastic material disposed between and connecting, the rear portions of the side members, whereby posterior motion of the football helmet is restricted when the football helmet contacts the connector plate member, and lateral motion of the football helmet is restricted when the football helmet contacts the inner wall surface of the side members.

2. The football helmet motion restrictor of claim 1, wherein the connector plate member includes a means for adjustably securing the connector plate member to the rear portions of the side members to permit the distance between the rear portions of the side members to be increased or decreased to conform with the size of the neck opening.

3. The football helmet motion restrictor of claim 1, including a layer of padding material disposed on the upper end of each side member.

4. The football helmet motion restrictor of claim 1, including a layer of padding material disposed on an inner wall surface of the connector plate member.

5. The football helmet motion restrictor of claim 4, wherein the layer of padding material and connector plate member include a means for releasably securing the layer of padding material to the connector plate member.

6. The football helmet motion restrictor of claim 5, wherein the releasable securing means is strips of a mating hook and eye fastening material.

7. The football helmet motion restrictor of claim 1, wherein a plurality of grooves are disposed in the inner wall surface of the side members, the grooves extending upwardly from the lower end to the upper end of each side member.

8. The football helmet motion restrictor of claim 7, wherein a plurality of ridges are disposed on an outer wall surface of each side member, the ridges extending upwardly from the lower end to the upper end of each side member.

9. The football helmet motion restrictor of claim 1, wherein the connector plate member is disposed between, and connecting, the side members with an upper end of the connector plate member being coaxially disposed with the upper end of the rear portions of the side members.

10. Football protective equipment for use by a person wearing a football helmet to restrict undesired lateral and posterior movement of the football helmet, comprising:

football shoulder pads including two bilaterally symmetrical arch members, each arch member having an upper portion, the upper portions forming a neck opening;

a pair of bilaterally symmetrical side members made of a rigid plastic material, each side member having a front and rear portion and an upper and lower end, and a mounting surface on the lower end the mounting surface of each side member being fixedly secured to an upper portion of an arch member; each side member having an upwardly extending inner wall surface which flares upwardly and outwardly from the lower end to the upper end; the lower end of each side member being sized to generally conform to the size and shape of the neck opening of the shoulder pads; the upper end of each side member being sized to be larger than the size and shape of the neck opening of the shoulder pads; the inner wall surface of each side member having a height which tapers downwardly from the rear portion to the front portion; and a substantially flat connector plate member made of a rigid plastic material disposed between and connecting, the rear portions of the side members, whereby posterior motion of the football helmet is restricted when the football helmet contacts the connector plate member, and lateral motion of the football helmet is restricted when the football helmet contacts the inner wall surface of the side members.

11. The football protective equipment of claim 10, wherein the connector plate member includes a means for adjustably securing the connector plate member to the rear portions of the side members to permit the distance between the rear portions of the side members to be increased or decreased to conform with the size of the neck opening.

12. The football protective equipment of claim 10, including a layer of padding material disposed on the upper end of each side member.

13. The football protective equipment of claim 10, including a layer of padding material disposed on an inner wall surface of the connector plate member.

14. The football protective equipment of claim 13, wherein the layer of padding material and connector plate member include a means for releasably securing the layer of padding material to the connector plate member.

15. The football protective equipment of claim 14, wherein the releasable securing means is strips of a mating hook and eye fastening material.

16. The football protective equipment of claim 10, wherein a plurality of grooves are disposed in the inner wall surface of the side members, the grooves extending upwardly from the lower end to the upper end of each side member.

17. The football protective equipment of claim 16, wherein a plurality of ridges are disposed on an outer wall surface of each side member, the ridges extending upwardly from the lower end to the upper end of each side member.

18. The football protective equipment of claim 10, wherein the connector plate member is disposed between, and connecting, the side members with an upper end of the connector plate member being coaxially disposed with the upper end of the rear portions of the side members.

* * * * *